United States Patent [19]

Aronoff

[11] 3,958,432

[45] May 25, 1976

[54] APPARATUS FOR TREATING TUBULAR FABRICS

[76] Inventor: Edward I. Aronoff, 605 Dorais St., St. Laurent, Quebec, Canada

[22] Filed: Feb. 25, 1974

[21] Appl. No.: 445,563

[52] U.S. Cl. ..... 68/13 R; 26/84; 28/74 R; 68/22 R; 68/175

[51] Int. Cl.[2] ..... D06B 23/02

[58] Field of Search ..... 8/151; 68/22 R, 68/13 R, 175; 26/55 R; 28/74 R; 118/44

[56] References Cited

UNITED STATES PATENTS

| | | | |
|---|---|---|---|
| 1,893,197 | 1/1933 | Cohn | 8/151 |
| 3,508,286 | 4/1970 | Rosen | 26/55 R X |
| 3,857,261 | 12/1974 | Wilcox | 68/175 X |

FOREIGN PATENTS OR APPLICATIONS

| | | | |
|---|---|---|---|
| 2,050,206 | 9/1970 | Germany | 68/22 R |

*Primary Examiner*—Peter Feldman
*Assistant Examiner*—Philip R. Coe
*Attorney, Agent, or Firm*—Robert E. Mitchell; Alan Swabey

[57] ABSTRACT

In the wet treatment of tubular fabric a ballooning phenomena occurs as the tubular fabric is withdrawn from the wet treatment upstream from the squeeze rolls which squeeze out the excess liquid in the fabric. A plurality of pairs of rollers are placed upstream of the squeeze rolls such that each pair includes a roller on either side of the fabric and spaced apart a short distance in order to reduce and control the ballooning phenomena and to knead the fabric whereby to increase the impregnation of the liquid in the fabric.

5 Claims, 4 Drawing Figures

APPARATUS FOR TREATING TUBULAR FABRICS

BACKGROUND OF THE INVENTION

1. Field of the Invention

The present invention relates to an apparatus for treating tubular fabrics and more particularly to apparatus for handling tubular fabrics when in a wet condition.

2. Description of the Prior Art

In the finishing of tubular knit fabrics, most of the dyeing and finishing steps are handled in batch processing steps. A continuous finishing process is not used since the speeds at which the fabrics are treated vary considerably with each step. For instance, in the calendering of the fabric, speeds in excess of 30 ft./min. and up to 60 ft./min. can be attained, while steps wherein the fabric is handled in a wet condition, the speeds are much slower. One of the reasons why the speed of handling a fabric in a wet condition is slower is that the tubular fabric tends to form a balloon when the fabric leaves a treating station in which it has been immersed in a liquid. This balloon causes the fabric to be distorted as inner forces are pressing the fabric outwardly thus causing it to stretch. This balloon phenomena is caused by the liquid and air trapped within the fabric. The balloon is normally formed between the liquid immersion area and the squeeze rollers normally provided to squeeze out the excess liquid.

Furthermore, the fabric must be passed through a liquid immersion station slowly in order to allow enough immersion time for liquid to impregnate the fabric fully. Alternatively, the bath in which the fabric is immersed could be lengthened in order to maintain the immersion time while increasing the speed at which the fabric is passing through the station. However, with the latter alternative, economy is comprised.

SUMMARY OF THE INVENTION

It is an object of the present invention to provide an improved apparatus for handling tubular fabrics as it leaves a wet treatment station whereby the ballooning phenomena is controlled reducing the stretching of the fabric caused by this ballooning phenomena. It is a further object to provide improved impregnation of the liquid in the fabric as the fabric leaves the wet treatment station.

Construction in accordance with the present invention for treating tubular fabrics comprises means for advancing the fabric in a wet condition along a predetermined planar path, during which a balloon forms, and a plurality of spaced apart pairs of opposed contacting surfaces with a surface on either side of said planar path, each pair of opposed surfaces being spaced apart a distance greater than the thickness of the fabric being treated but less than a distance out of contact with the fabric, thereby kneading the fabric.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
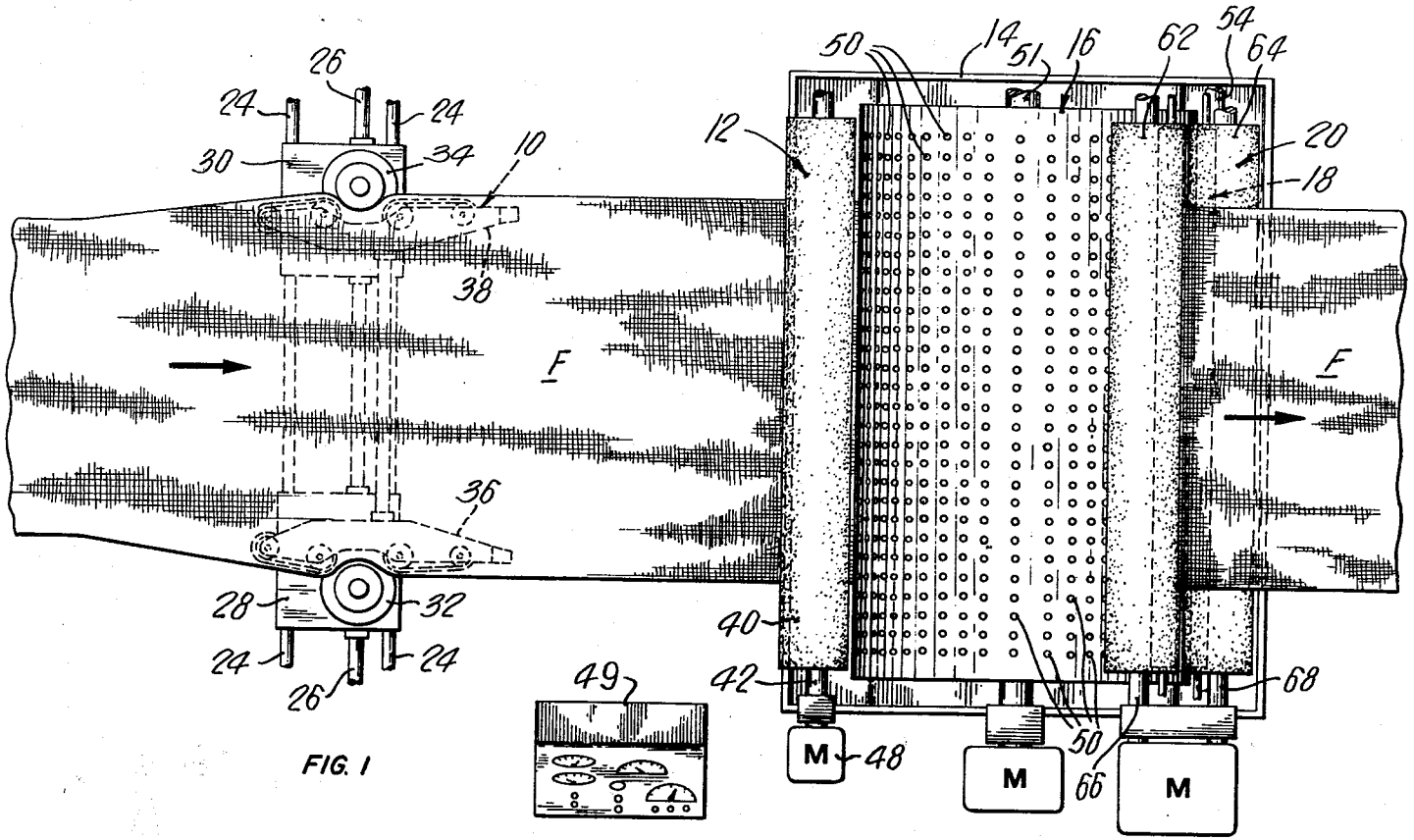
FIG. 1 is a top plan view of an embodiment of the present invention.

Referring now to the drawings, there is shown a typical wet treating station in the finishing of a tubular fabric. The wet station in this embodiment is resin impregnating bath through which the finished fabric is passed through in order to set the loops.

Figures 2, 3, 4:
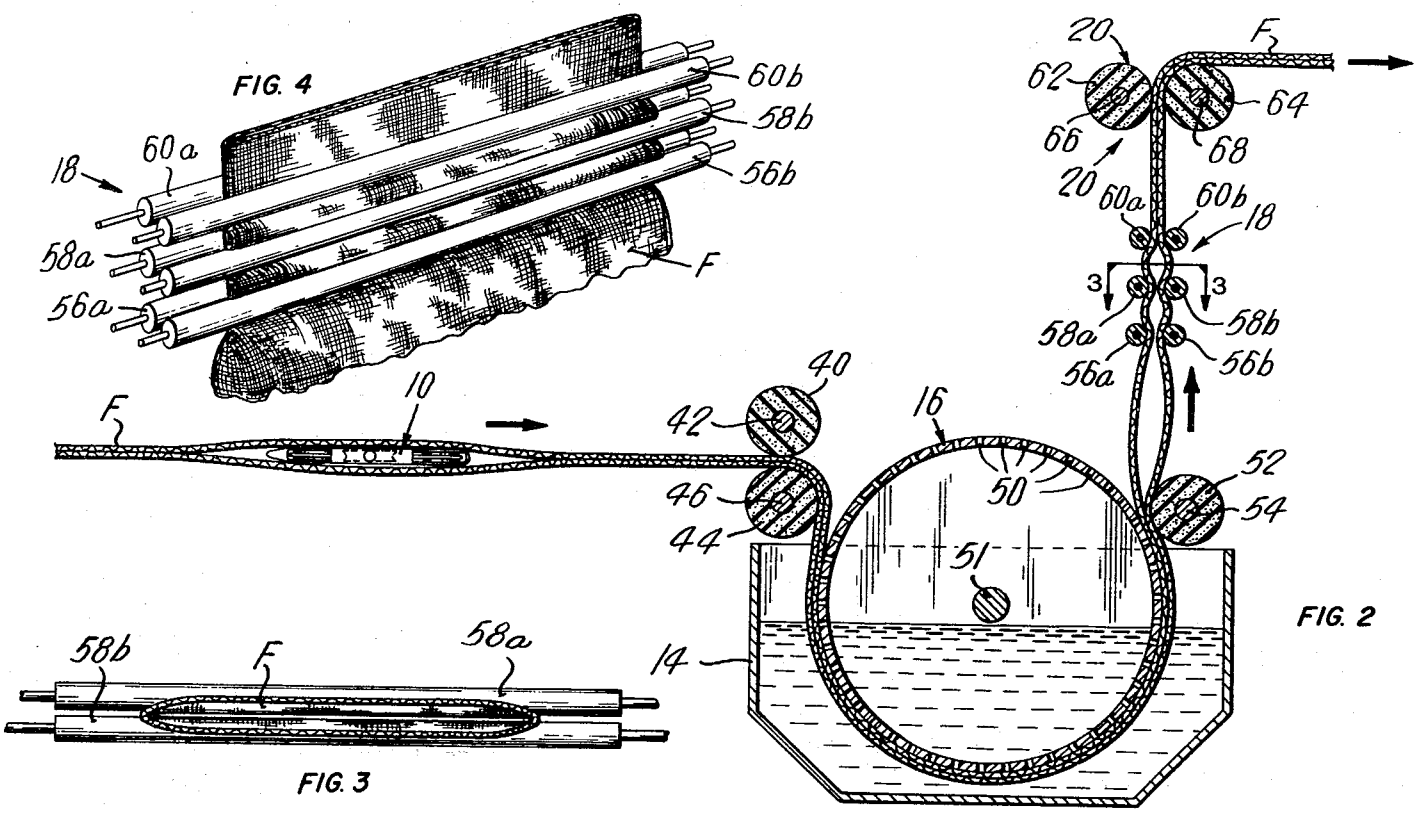
FIG. 2 is a vertical schematic cross-section view taken generally longitudinally through the apparatus shown in FIG. 1.
FIG. 3 is a horizontal cross-section taken along lines 3—3 of FIG. 2.
FIG. 4 is a fragmentary perspective view of the detail shown in FIG. 3.

The fabric is identified generally by the letter F and passes through the station in the direction of the arrow. In order to align the fabric and maintain it in a flattened condition, fabric F passes over a stretcher device 10 and then passes between a pair of driven rollers 12 and into the bath 14 while being guided by a perforated drum 16 as shown in FIG. 2. The fabric then passes through kneading rollers 18 and the excess liquid is squeezed out of the fabric by means of squeeze rollers 20 which are ranged in a vertical plane above the exit of the bath 14.

The stretcher device 10 includes a conventional belt-stretcher apparatus including guide rods 24 and a drive shaft 26. The drive shaft 26 passes through the pair of gear boxes 28 and 30 and drives through peripheral grooved wheels 32 and 34 which in turn engage respective belts on belt supports 36 and 38. It is not intended to stretch the fabric at this point beyond the width it has attained at the time it reaches the station. The stretcher device 10 is used in order to present the tubular fabric in a flattened unwrinkled condition to the bath 14.

The driven rollers 12 include a roller 40 mounted on a shaft 42 and an opposed roller 44 on a shaft 46. A slight pressure is applied on the rollers so as to grip the fabric and drive it into the bath. One of the shafts 42 or 46 is operatively connected to a D.C. motor 48. The speed at which the fabric F is fed into the bath can be controlled by varying the speed of the D.C. motor 48 through a conventional control panel 49.

The bath 14 contains liquid resin to be impregnated in the fabric. The drum 16 is mounted on a shaft 51 and is immersed in the liquid resin in the bath 14. The drum 16 can be made of a cylindrical sheet metal with a plurality of perforations 50 provided therein or it could also be made of screen material to allow the liquid to pass through the drum at ease thereby contacting the surfaces of the fabric on both sides as the fabric F passes around the drum 16.

As the fabric F comes off the drum 16 it passes by the exit roller 52 mounted on a shaft 54 which helps to squeeze off the excess liquid as the fabric comes out of the bath. The fabric then passes upwardly in a vertical plane towards the squeeze rollers 20.

Normally, in this situation, and at the speeds of over 20 or 30 feet per minute, the tubular fabric would tend to balloon outwardly caused by air and liquid on the inside of the tube and being forced upstream by means of the squeeze rollers 20. Such ballooning caused the stitches or loops to be distorted somewhat and in order to avoid this, in the past, the speed had to be greatly reduced so that the ballooning did not occur. Other attempts were made to remove the balloon from the fabric for instance, by using vacuum devices.

The present invention as shown in FIGS. 2 to 4, for instance, includes a plurality of pairs of rollers provided on either side of the vertical plane through which the fabric passes. These rollers include opposed rollers 56*a* and 56*b* which are spaced apart slightly. Rollers 58*a*, 58*b* are spaced above the rollers 56 while rollers 60*a* and 60*b* which are similar to rollers 56 and 58 are spaced thereabove. Each set of rollers face the other and are spaced apart a distance which is greater than the thickness of the tubular fabric, but which is not so great that the fabric, as it is being ballooned, would not contact the roller. It has been found that the rollers 18 act further to knead the fabric, particularly at the stage where there is much resin on the outer surfaces of the fabric which may not have been properly impregnated within the fabric particularly since the speeds at which the fabric is passed through the bath is increased. The rollers have been found to help this impregnation action of the resin through its kneading action on the fabric.

Finally, the tubular fabric passes the squeeze rollers 20 comprising pair 62, 64 which press on the tubular fabric to remove all of the remaining excess liquid which cascades down in the vertical plane through the rollers 18 and also back into the fabric to increase the impregnation of the resin in the fabric.

I claim:

1. An apparatus for continuously treating tubular fabric when in a wet condition and which fabric tends to balloon when emerging from a liquid treatment bath, comprising means for advancing tubular fabric upwardly from a liquid treatment bath along a predetermined substantially vertical planar path;

means along said path tending to form a balloon in the tubular fabric as it emerges from the liquid bath; and a plurality of vertically spaced apart pairs of opposed fabric contacting means with each pair having a surface on respective opposite sides of the planar path, the opposed surfaces on each pair being spaced apart a distance greater than the thickness of the tubular fabric being treated but less than a distance out of contact with the tubular fabric thereby to reduce ballooning in the fabric and to knead the tubular fabric.

2. An apparatus as defined in claim 1 wherein the opposed fabric contacting means are idler rollers.

3. An apparatus as defined in claim 2 wherein there are three pairs of said idler rollers.

4. An apparatus as defined in claim 1 including an upstream, liquid immersion station, and squeeze rollers for removing excess liquid from the fabric downstream of the liquid immersion station, the plurality of contacting surfaces being between the liquid immersion station and the squeeze rollers.

5. An apparatus as defined in claim 1 wherein the planar path includes an upper pair of squeeze rollers above the plurality of vertically spaced apart pairs for removing excess liquid from the fabric and causing the liquid to cascade down on the fabric.

* * * * *